United States Patent [19]

Meijer

[11] Patent Number: 4,516,713

[45] Date of Patent: May 14, 1985

[54] LOW-WIRE SENSOR

[75] Inventor: Wilhelmus Meijer, Venlo, Netherlands

[73] Assignee: Xerox Corporation, Stamford, Conn.

[21] Appl. No.: 511,038

[22] Filed: Jul. 5, 1983

[30] Foreign Application Priority Data

Jul. 7, 1982 [GB] United Kingdom ..... 8219708

[51] Int. Cl.[3] ..... B27F 7/27; B27F 7/38

[52] U.S. Cl. ..... 227/2; 116/282; 242/203; 227/4; 227/6; 227/1

[58] Field of Search ..... 227/1, 2, 3, 4, 156, 227/5, 6, 7; 242/1 R, 54 R, 203; 116/282, 283

[56] References Cited

U.S. PATENT DOCUMENTS 3,917,190 11/1975 Richt ..... 242/203

*Primary Examiner*—Paul A. Bell

*Attorney, Agent, or Firm*—Bernard A. Chiama

[57] ABSTRACT

A low-wire sensor for sensing when the amount of wire W remaining on a spool 102 falls below a predetermined low level, comprising a lever 11 biased by a spring 15 so as to press against the wire W on the spool exceeds the low level and to disengage from the wire when the wire reaches said low level for movement to a wire-low indicating position in which it suitably actuates a sensor switch.

3 Claims, 2 Drawing Figures

LOW-WIRE SENSOR

This invention relates to a low-wire sensor for apparatus in which wire is supplied from a spool, for sensing when the amount of wire remaining on the spool falls below a predetermined low level. An example of such apparatus in which wire is supplied from a spool is a wire stitcher, particularly for binding sets or signatures of sheets or documents, in which staples are formed from a continuous wire wound on a spool from which pieces are cut and formed in the machine.

It is desirable in such apparatus to have an indication as to when the wire has reached a low level so as to avoid the wire running out during a run or to allow time for a visit by a specialist operator to replace the spool. Low-wire sensors are known which take the form of a pivoted lever which is spring-pressed against the outer surface of the wire on the spool and which actuates a sensor switch when the wire reaches a predetermined low level or has been consumed. The problem with such devices is that they rely on a relatively small movement of the lever to actuate the switch and cannot be relied upon to give an accurate indication of the amount of wire remaining.

A low wire sensor according to the present invention comprises a spring-biased lever arranged to press against the wire on the spool when the wire exceeds a predetermined low level and to disengage from the wire when the wire reaches said predetermined low level for movement to a wire-low indicating position.

In a preferred form, the sensor comprises a pivoted spring-biased lever having an end engageable with the outer surface of the wire on the spool and movable under the influence of said spring through a position in which said lever extends radially of the spool and the end of the lever is spaced a predetermined distance from the core of the spool, towards a wire-low indicating position at one side of the radius from positions on the other side of said radius in which in engages and is restrained by wire exceeding said low level.

Preferably in its low-wire indicating position the lever actuates a low wire switch which suitably causes illumination a low-wire indicator panel.

While a sensor according to this invention is particularly suitable for sensing when the wire has reached a predetermined low but is not completely consumed, it will be understood that by suitable setting of the lever it may equally determine when the wire has been comsumed.

Figure 1:
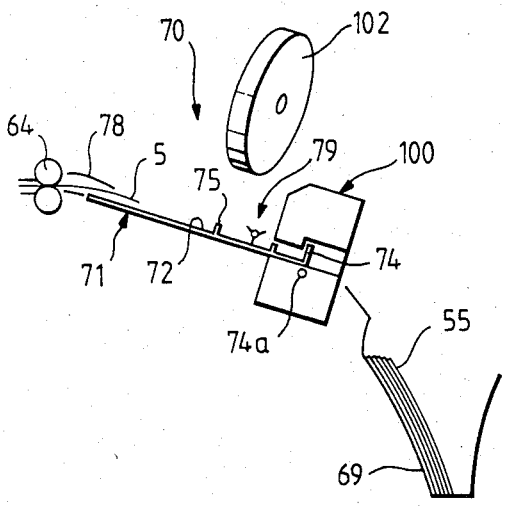
Figure 2:
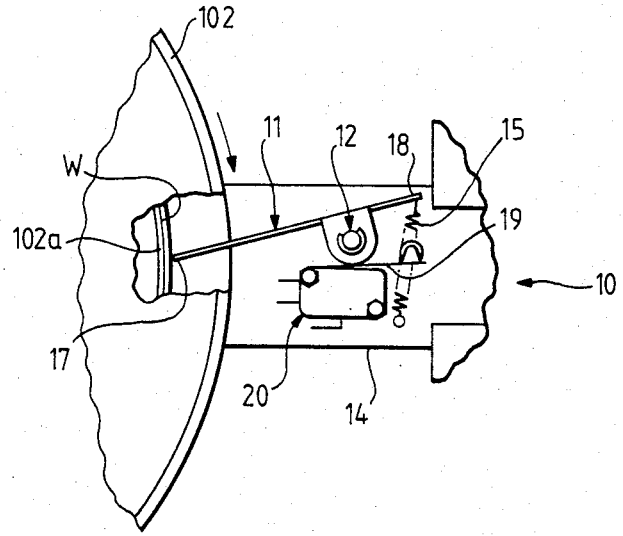

In order that the invention may be more readily understood reference will now be made to the accompanying drawings, in which:

FIG. 1 is a schematic side elevation of a finisher incorporating a spool-fed wire stitcher having a low wire sensor according to the present invention, and FIG. 2 shows a low-wire sensor according to the present invention.

Referring to FIG. 1 there is shown a finisher 70 incorporating a stitcher 100 according to this invention. The finisher is adapted to be arranged at the output of a photocopier represented in the drawing by the output nip rolls 64,65 thereof. Although particularly well suited for use with a photocopier, the apparatus generally designated 700 is equally well adapted for use with any number of devices in which cut sheets of material are delivered or compiled in a stack.

The finisher 70 comprises a tray 71 having a base or support surface 72 inclined downwardly in the direction of sheet travel towards a registration corner defined by registration fences 74, 75 extending along the lower edge and one side of the tray. Above the upper end of the support surface are arranged the output feed rolls 64, 65 of the photocopier. From the feed rolls 64, 65 a sheet is directed by a guide plate 78 towards the tray 71. A corner registration device 79, such as a paddle wheel like that described in U.S. Pat. No. 3,669,447 is arranged over the surface 72 to urge the sheets S into the registration corner to position them to receive a stitch from the apparatus 100. The registration fence 74 is rotatable about an axis 74*a* so that it may be retracted for ejection of bound sets SS into a collection tray 79. Any suitable ejection mechanism, such as drive rollers, may be employed.

The stitcher 100 may take any suitable form but a preferred from thereof is described and illustrated in our copending European Application No. 0013164. Wire is delivered to the stitcher 100 from a spool 102 and a low-wire sensor 10 according to the invention is provided for sensing when the amount of wire remaining on the spool 102 falls below a predetermined low level. The sensor 10 comprises a lever 11 pivoted about an axis 12 for rotation in the plane of the spool. The lever 11 is mounted on a bracket 14 and spring-biased by a tension spring 15 connected between the outer end 16 of the lever and the bracket 14. The inner end 17 of the lever 11 is arranged to engage the outer surface of the wire W wound on the spool 102 when this exceeds the predetermined low level. As the wire W is consumed the lever rotates clockwise under the influence of the spring 15 until, when the wire has reached the predetermined low, the lever extends radially of the spool with its inner end 17 spaced a predetermined distance from the core 102*a* of the spool. At this point the inner end of the lever 11 is freed from engagement with the wire W and the lever will pivot under the influence of the spring 15 through a distance which is independent of the of wire remaining on the spool. As shown, the lever 11 rotates until the outer end 18 thereof strikes the actuator 19 of a sensor switch 20 mounted on the bracket 14

The switch 20 is suitably connected in a circuit including a low-wire display indicator which is lit when the circuit is completed thus providing a visual indication of the low wire condition.

It will be understood that various modifications may be made to the specific details referred to herein without departing from the scope of the invention as defined in the appended claims. For example, the low-wire indication may be provided by the lever 11 itself or it may actuate a mechanical indicator. Further an audible indication may be provided in addition to or instead of a visual one.

Further, it is to be understood that while primarily intended for sensing wire on a spool, the invention is equally applicable to the sensing of other spool-wound materials either in strip or filament form, such as adhesive binding tape, and the term 'wire' used herein and in the claims is intended to include such other filament and strip materials.

I claim:

1. A low-wire sensor for apparatus in which wire is supplied from a spool, for sensing when the amount of wire remaining on the spool falls below a predetermined low level, comprising a pivoted spring-biased lever having an end engageable with the outer surface of the wire wound on the spool and movable under the influence of said spring through a position in which said lever extends along a radius of the spool and the end of the lever is spaced a predetermined distance from the core of the spool, towards a low-wire indicating position at one side of the radius from positions on the other side of said radius in which it engages and is restrained by wire exceeding said low level.

2. A low-wire sensor according to claim 1 in which said lever actuates a sensor switch in said wire low indicating position to cause a visual or audible indication.

3. A wire stitcher for binding sets or signatures of sheets or documents, in which staples are formed from a continuous wire wound on a spool from which pieces are cut and formed in the machine, including a low-wire sensor comprising a pivoted spring-biased lever having an end engageable with the outer surface of the wire wound on the spool and movable under the influence of said spring through a position in which said lever extends along a radius of the spool and the end of the lever is spaced a predetermined distance from the core of the spool, towards a low-wire indicating position at one side of the radius from positions on the other side of said radius in which it engages and is restrained by wire exceeding said low level.

* * * * *